US006637461B2

(12) United States Patent
Post

(10) Patent No.: US 6,637,461 B2
(45) Date of Patent: Oct. 28, 2003

(54) ELECTRICALLY OPERATED HYDRAULIC ACTUATOR WITH FORCE FEEDBACK POSITION SENSING

(75) Inventor: Timothy A. Post, Brookfield, WI (US)

(73) Assignee: Husco International, Inc., Waukesha, WI (US)

( * ) Notice: Subject to any disclaimer, the term of this patent is extended or adjusted under 35 U.S.C. 154(b) by 4 days.

(21) Appl. No.: 10/094,744

(22) Filed: Mar. 8, 2002

(65) Prior Publication Data

US 2003/0168113 A1 Sep. 11, 2003

(51) Int. Cl.[7] ..... F15B 13/043; F15B 9/08

(52) U.S. Cl. ..... 137/625.63; 91/382; 91/464; 137/625.64

(58) Field of Search ..... 137/625.63, 625.64; 91/382, 464

(56) References Cited

U.S. PATENT DOCUMENTS

| | | | | |
|---|---|---|---|---|
| 3,653,409 A | * | 4/1972 | Brannon | 137/625.63 |
| 3,875,849 A | * | 4/1975 | Patel | 137/625.64 |
| 4,011,891 A | * | 3/1977 | Knutson et al. | 137/625.63 |
| 4,290,447 A | * | 9/1981 | Knutson | 137/625.64 |
| 4,569,273 A | * | 2/1986 | Anderson et al. | 137/625.63 |
| 5,715,865 A | | 2/1998 | Wilke | |
| 5,921,279 A | | 7/1999 | Barber | |

OTHER PUBLICATIONS

Jack L. Johnson, PE, "Design of Electrohydraulic Systems For Industrial Motion Control," 1991, pp. 4–15 & 4–16.

* cited by examiner

*Primary Examiner*—Gerald A. Michalsky
(74) *Attorney, Agent, or Firm*—George E. Haas; Quarles & Brady LLP

(57) ABSTRACT

A proportional hydraulic valve has a primary control spool with a force feedback actuator attached to one end, wherein the control spool meters flow of fluid to a work port. The force feedback actuator includes a piston coupled to the control spool and defining a first control chamber and a second control chamber on opposite sides of the piston. The surface of the piston has a depression with a first tapered section and a second tapered section. The force feedback actuator includes first electrohydraulic valve with a valve element that meters pressurized fluid selectively to the first and second control chambers to move the piston in opposite directions and produce motion of the control spool. A solenoid exerts a first force that on the valve element. A pilot pin engages the piston and the valve element, whereby, movement of the pilot pin on the first and second tapered sections of the piston applies a second force to the valve element. The second force corresponds to the position of the control spool and closes the valve element when the control spool is at a desired location corresponding to magnitude of the first force.

22 Claims, 6 Drawing Sheets

ELECTRICALLY OPERATED HYDRAULIC ACTUATOR WITH FORCE FEEDBACK POSITION SENSING

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to electrically operated hydraulic actuators, and more particularly to such actuators of a force-feedback type which are particularly suited to operating linear actuated control valves in hydraulic systems.

2. Description of the Related Art

Construction and agricultural equipment have moveable members which are operated by hydraulic cylinder and piston combinations. The cylinder is divided into two internal chambers by the piston and alternate application of hydraulic fluid under pressure to each chamber moves the piston in opposite directions.

Application of hydraulic fluid to the cylinder historically was controlled by a manually operated valve in which the human operator moved a lever that was mechanically connected to a spool within a bore of the valve. Movement of that lever placed the spool into various positions with respect to cavities in the bore that communicate with a pump outlet, a fluid reservoir or the cylinder. Moving the spool in one direction controlled flow of pressurized hydraulic fluid from the pump to one of the cylinder chambers and allowed fluid in the other chamber to flow to the reservoir. Moving the spool in the opposite direction reversed the application and draining of fluid with respect to the cylinder chambers. By varying the amount that the spool was moved in the appropriate direction, the rate at which fluid flows into the associated cylinder chamber was varied, thus moving the piston at proportionally different speeds.

In addition, some control valves provide a float position in which both cylinder chambers are connected simultaneously via the spool to the fluid reservoir. This position allows the machine member driven by the cylinder to move freely in response to external forces. For example, a snow plow blade is allowed to float against the pavement to accommodate variations in surface contour and avoid digging into the pavement.

There is a trend with respect to construction and agricultural equipment away from manually operated hydraulic valves toward electrically controlled solenoid valves. U.S. Pat. No. 5,921,279 describes coupling a solenoid to the end of the spool to operate a control valve. Because the solenoid was capable of driving the spool in only one direction, a pair of such solenoid operated spool valves was required for each work port of the valve assembly. One of those valves controlled movement of the piston in one direction, while the other valve produced piston movement in the other direction.

It is important that the solenoid be able to accurately position the spool to meter the fluid through the valve at the desired flow rate. In an ideal valve, the position of the spool has a constant relationship to the magnitude of electric current applied to the solenoid. This ideal situation assumes that the other forces acting on the spool remain constant over the life of the control valve. In the real world, friction and other forces which affect spool movement vary as the device ages so that the same magnitude of electric current applied to the solenoid does not move the spool into the same position over time. Thus the fluid flow through the valve at a given electric current level changes during the life of the valve.

It is desirable to provide a control valve assembly that consistently locates the spool at the same position when a given magnitude of electric current is applied to the solenoid, even though when other forces acting of the spool change.

SUMMARY OF THE INVENTION

A proportional hydraulic control valve comprises a body with a bore therein, and having a work port, a supply passage, and a tank passage all of which communicate with the bore. A hydraulic motor can be connected to the work port. A pump can be connected to the supply passage and a fluid reservoir of the hydraulic system receiver fluid from the tank passage. A flow control component, such as a valve spool for example, is accommodated in the bore for reciprocal movement therein to provide a first fluid path between the work port and the supply passage and a second fluid path between the work port and the tank passage.

The proportional hydraulic control valve is operated by a force feedback actuator which has a piston that is coupled to the flow control component. The piston defines a first control chamber and a second control chamber on opposite sides of the piston in the bore. The piston has opposing ends with a depression forming a contoured surface there between that has first and second tapered sections. In the preferred embodiment, the piston has an hourglass shape.

The force feedback actuator includes a valve actuator that has a valve element which meters pressurized fluid selectively to the first and second control chambers thereby producing movement of the piston in opposite directions. That movement of the piston causes the flow control component to move into positions at which the first fluid path and the second fluid path are formed. The valve assembly including an valve actuator which produces a first force that is applied to move the valve element. A pilot pin engages the piston and the valve assembly wherein movement of the pilot pin on the first and second tapered sections of the piston transfers a second force to the valve element.

The first force from the valve actuator corresponds to a desired position for the flow control component. The second, or feedback, force indicates the actual position of the flow control component and places the valve element into a closed state when the control spool is at the desired position.

In the preferred embodiment, the linear actuator comprises first and second electrohydraulic valves. The first electrohydraulic valve includes the actuator and the valve element. The first electrohydraulic valve has a first state in which the pressurized fluid is proportionally metered to a valve outlet connected to the first control chamber, a second state in which the first control chamber is coupled to a tank passage, and a third state in which the first control chamber is isolated from both the tank passage and the source of pressurized fluid. The second electrohydraulic valve has a fourth state in which the second control chamber is coupled to the tank passage, and a fifth state in which the second control chamber is coupled to the outlet of the first electro-hydraulic valve.

DETAILED DESCRIPTION OF THE INVENTION

Figure 1:
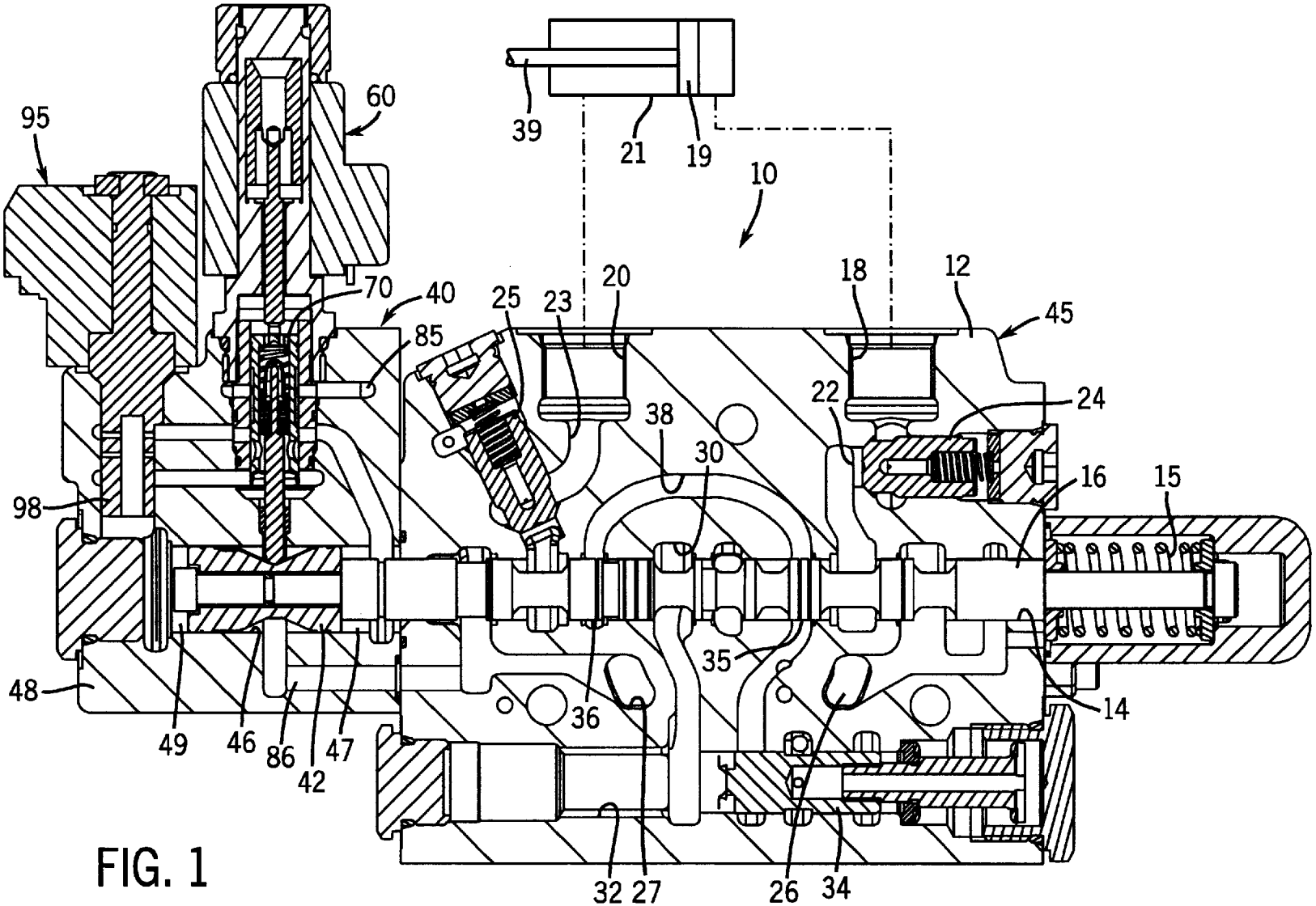
FIG. 1 is a cross section through a solenoid operated spool control valve according to the present invention.

With initial reference to FIG. 1, a control valve 10 comprises a valve block 12 having a bore 14 extending there through. A control spool 16 forms a flow control component and is located in the bore 14 and can move longitudinally in a reciprocal manner to control the flow of hydraulic fluid to a pair of work ports 18 and 20. A dual action spring assembly 15 is connected to a first end of the control spool 16 to return the spool to the illustrated centered neutral position in the bore 14. The control spool 16 has a plurality of axially spaced circumferential grooves located between lands which cooperate with the bore 14 to control the flow of hydraulic fluid between different cavities and openings into the bores, as will be described.

The first and second work ports 18 and 20 are respectively connected by the first and second work port passages 22 and 23 to cavities extending around the bore 14. A separate check valve 24 or 25 is located in each of the first and second work port passages 22 and 23, respectively. The work ports 18 and 20 are connected to a hydraulic motor such as a cylinder 21 and piston 19 arrangement . In an exemplary hydraulic system, the first work port 18 can be connected to the head chamber of a hydraulic cylinder 21 and the second work port 20 can be connected to the rod chamber of that cylinder, for example. The piston 19 and cylinder 21 form a hydraulic motor and it should be understood that the present control valve can be used with other types of hydraulic motors, such as a single acting cylinder or a rotating motor, for example.

The valve block 12 has a plurality of passages extending perpendicular to the plane of the cross-section of FIG. 1. A pair of such passages 26 and 27 are connected to the tank of the hydraulic system of which the valve assembly 10 is a component. Both tank passages 26 and 27 open into a different cavity extending around the spool bore 14. The valve block 12 also has a supply passage 30 that opens into the spool bore 14 and is connected to the output of a pump (not shown) of the hydraulic system. The supply passage 30 communicates with another bore 32 in the valve block 12 which contains a conventional pressure compensator 34. The pressure compensator 34 controls the flow of hydraulic fluid from the supply passage 30 to a pair of pump cavities 35 and 36 around the spool bore 14 which are connected by a bridge passage 38.

The valve block 12 preferably is formed of several segments bolted together to provide an interconnection of the various bores, passages, and ports. It should be understood that the present invention can be used with other types of spool control valves in additional to the specific one being described herein.

FIG. 1 illustrates the control spool 16 in the neutral, or centered, position at which fluid is not flowing into or out of the work ports 18 and 20. Movement of the control spool 16 to the right in the drawing connects the first work port 18 to the tank passage 26 and connects the second work port 20 to the supply passage 30 via the bridge passage 38 and the pressure compensator 34. This action applies pressurized hydraulic fluid from the system pump to the rod chamber of cylinder 21 and drains fluid from the cylinder head chamber to the system tank. As a result, the piston rod 39 retracts into the cylinder 21. Movement of the control spool 16 to the left in the drawing connects the first work port 18 to the supply passage 30 and the second work port 20 to the tank passage 27. This causes pressurized hydraulic fluid from the system pump to flow to the head chamber of the cylinder 21 and fluid to be drained from the rod chamber, thereby extending the piston rod 39 from the cylinder.

Reference herein to directional relationship and movement, such as top and bottom, left and right, or up and down, refer to the relationship and movement of the components in the orientation illustrated in the drawings, which may not be the orientation of the components in other embodiments of the present invention.

The second end of the control spool 16, which is remote from the dual action spring assembly 15, is connected to a force feedback actuator 40. The force feedback actuator 40 has an end block 48 attached to one side of the valve block 12 so that a bore 46 in the end block is aligned with the spool bore 14. The end block bore 46 contains a piston 42 that is attached to the second end of the control spool 16. Alternatively the control spool 16 and the piston 42 may be formed as a single piece. In either construction, the piston 42 and the control spool 16 move reciprocally as a common unit. First and second piston control chambers 47 and 49 are defined within the bore 46 on opposite sides of the piston 42. Although, the end block 48 is separate from the valve block 12, the two components could be formed as a single piece and thus collectively are being referred to herein as a body 45. In a single piece body, the spool bore 14 and the piston bore 46 would comprise a common bore.

Figure 2:
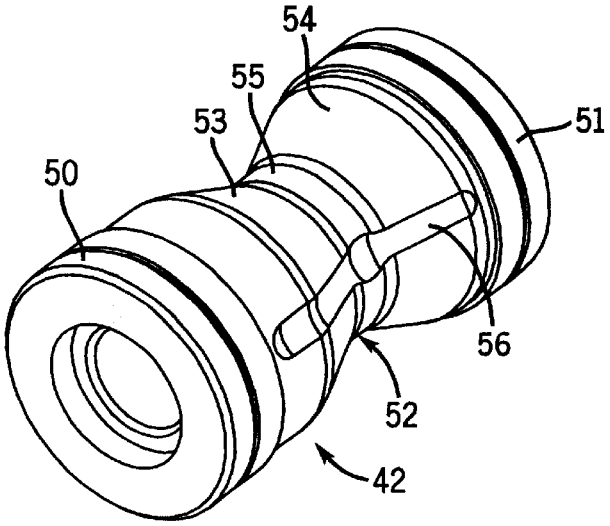
FIG. 2 is an isometric view of a piston within the control valve.

With additional reference to FIG. 2, the piston 42 has a generally hourglass shape with circular end sections 50 and 51 and a depression forming a contoured surface, preferably in the form of an annular notch 52, between the end sections. The annular notch 52 has frustoconical tapered sections 53 and 54 extending, respectively, from the relatively thick end sections 50 and 51 to the thinner intermediate piston section 55 at the bottom of the notch. Although the tapered sections 53 and 54 are illustrated with surfaces that taper in a linearly from the end sections to the smallest diameter portion of the notch, other surface contours, such as a concave or convex curved surface, may be employed. A longitudinal groove 56 extends along outer surface of the piston 42 from one circular end 50 to the other 51. Alternatively instead of a notch 52, the piston 42 may have a cylindrical shape with a large concave longitudinal groove corresponding to the profile of groove 56.

Figure 4:
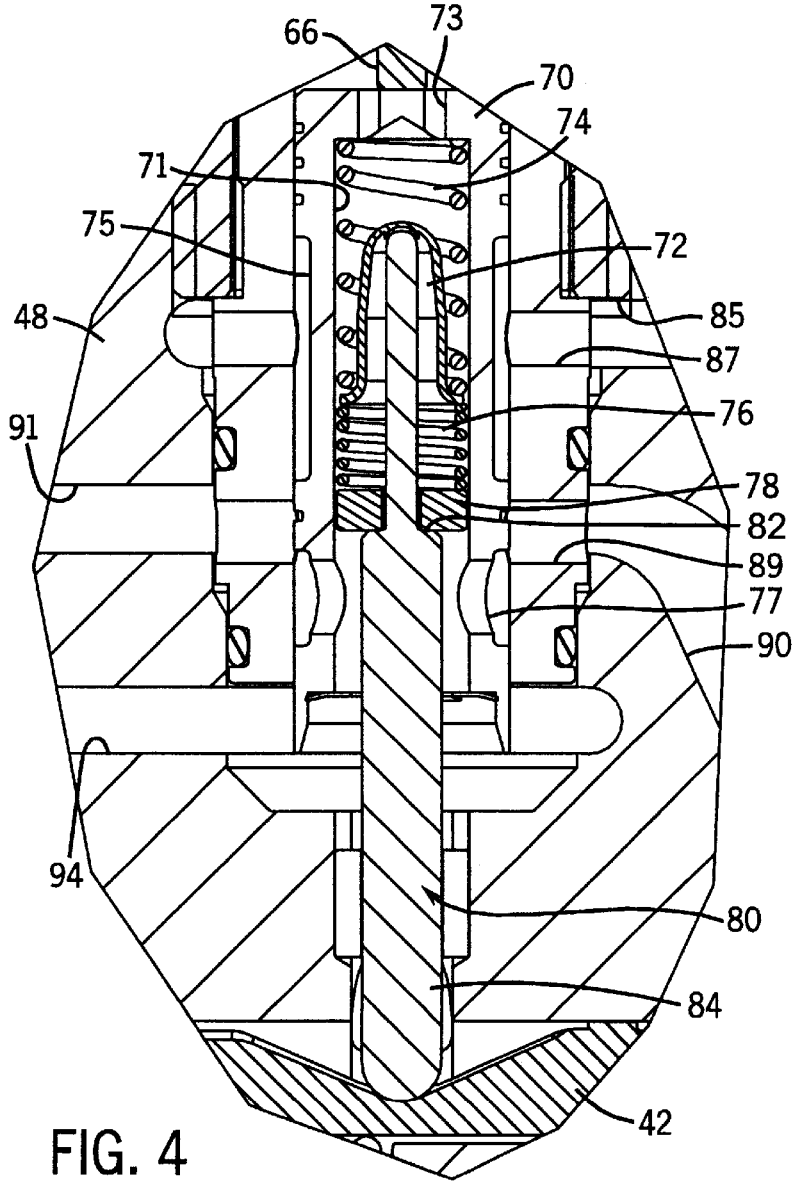
FIG. 4 is an enlarged cross sectional view of a valve element and pilot pin of the linear actuator in FIG. 3.
Figure 3:
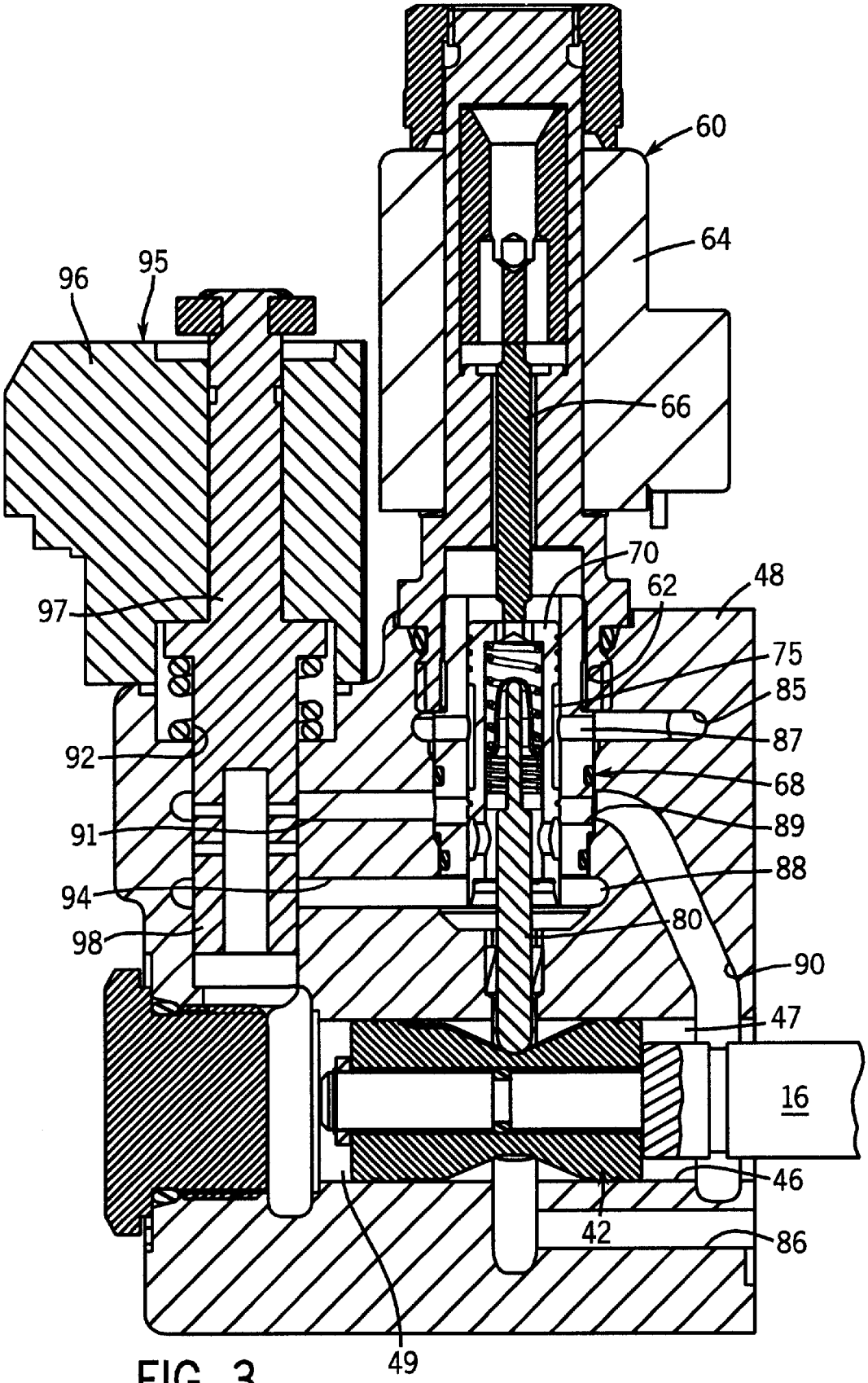
FIG. 3 is a cross section through a linear actuator of the control valve in the neutral position.

Referring to FIGS. 1 and 3, a proportional first electro-hydraulic (EH) valve 60 is mounted in a first bore 62 which extends into the end block 46 and intersects the piston bore 46 at a right angle. The first EH valve 60 has an electrical actuator comprising a first solenoid 64 which when energized, produces movement of an armature 66 that selectively engages a valve element assembly 68. With additional reference to FIG. 4, the valve element assembly 68 comprises a valve element 70 with an central aperture 71 having an open end facing the piston 42 and an inner end with a small opening 73 there through into which the solenoid armature 66 extends. The valve element 70 has an exterior annular groove 75 and a transverse aperture 77. As will be described, operation of the armature 66 by the first solenoid 64 moves the valve element 70 to proportionally control flow of fluid into the first and second piston control chambers 47 and 49.

A cap 72, within the valve element 70, is biased by a first spring 74 away from the inner end of the central aperture 71. A second spring 76 is located between the cap 72 and a disk 78 that faces the open end of the central aperture 71. A feedback pin 80 extends through the disk 78 and has a first end which engages the cap 72. A shoulder 82 on the feedback pin abuts the disk 78. A larger diameter portion 84 of the feedback pin 80 projects from the first EH valve 60 and has a rounded end that is received in the longitudinal groove 56 in the piston 42 (see FIG. 2). The engagement of the rounded end of the pilot pin 80 with the groove 56 of the piston 42 provides a linear contact between those components. Without providing the groove 56, the pilot pin would have a point contact with the curved surface of the piston 42 which would produce relatively large stress at the point of contact. The linear engagement of the two components reduces the contact stress.

Referring again to FIGS. 1 and 3, a pilot pressure passage 85 communicates with the first bore 62 and receives fluid at a constant regulated pilot pressure ($P_{ILOT}$) for controlling the operation of the piston 42, as will be described. The end block 48 also has a pilot tank passage 86 which communicates with tank passage 27 in the valve block 12. The pilot tank passage 86 leads to the intersection of the actuator bore 46 and the first bore 62 for the first EH valve 60. As a consequence, a cavity 88 between the first EH valve 60 and the piston bore 46 always communicates with the tank passage 27. A branch passage 90 extends from the first piston control chamber 47 on the spool side of the piston 42 to the first bore 62. A first transverse passage 91 is a continuation of the branch passage 90 from first bore 62 to passage a second bore 92 which is parallel to the first bore in the end block 48 and opens into the second control chamber 49. A second transverse passage 94 extends between the chamber 88 in the first bore 62 and the second bore 92.

A second electrohydraulic valve 95 has an electrical actuator formed by second solenoid 96 which operates an armature 97 to move a valve member 98 within the second bore 92. The second EH valve 95 is an on/off type valve having two states: energized and de-energized. When the second EH valve 95 is de-energized, the valve member 98 is positioned to connect the first transverse passage 91 to the second piston control chamber 49. Alternately, when the second EH valve 95 is energized, the second transverse passage 94, which is coupled to the tank passages 86 and 27, is connected to the second piston control chamber 49. However, one skilled in the art will appreciate that the connections provided in the energized and de-energized states of the second EH valve 95 may be reversed with a commensurate reversal of the activation of the second solenoid 96 in the subsequent description of the second EH valve's operation. Furthermore, although specific designs of the valve element 70 and valve member 98 are shown in the drawings, other types of these components which perform the same function are contemplated within the scope of the present invention. For example, valve poppets could be employed.

The first electrohydraulic valve 60 is a proportional device which meters the fluid from the pilot pressure passage 85 to control the position of the spool 16 and thus the rate at which fluid is supplied to the work ports 18 and 20. The two states of the second electrohydraulic valve 95 determine the direction of movement of the piston 42 and thus of the control spool 16. The movement direction of the control spool 16 determines whether the piston rod 39 is extended from or retracted into the hydraulic actuator formed by cylinder 21.

FIGS. 1 and 3 illustrate the control valve 10 in the neutral position in which fluid is not being applied to or drained from the cylinder 21. In this mode of operation, the first EH valve 60 is maintained in a de-energized state, so that its valve element 70 closes communication with the pilot pressure passage 85. As a consequence, the valve element 70 is a position in which the branch passage 90, that opens into the first piston control chamber 47, is connected to the pilot tank passage 86 and there through to the tank. Thus, the first piston control chamber 46 is at tank pressure. The second EH valve 95 also is de-energized which places its valve member 98 in a position that connects the first transverse passage 91 to the second piston control chamber 49. As noted previously, the first transverse passage 91 is connected to the outlet of the proportional first EH valve 60 which now is connected to the pilot tank passage 86 that leads to the system tank. Therefore, the second piston control chamber 49 also is at tank pressure. One would also note that even if the second EH valve 95 was energized in this state, its valve member 98 would connect the second transverses passage 94 from the tank chamber 88 of the first EH valve 60 to the second piston control chamber 49 which also places that latter chamber at tank pressure. As a consequence, in the neutral state of the control valve 10, both of the piston control chambers 47 and 49 are at tank pressure which allows the dual spring assembly 15 to center the control spool 16 in the illustrated position in which the two work port passages 22 and 23 are isolated from the other passages and cavities connected to the spool bore.

Figure 5:
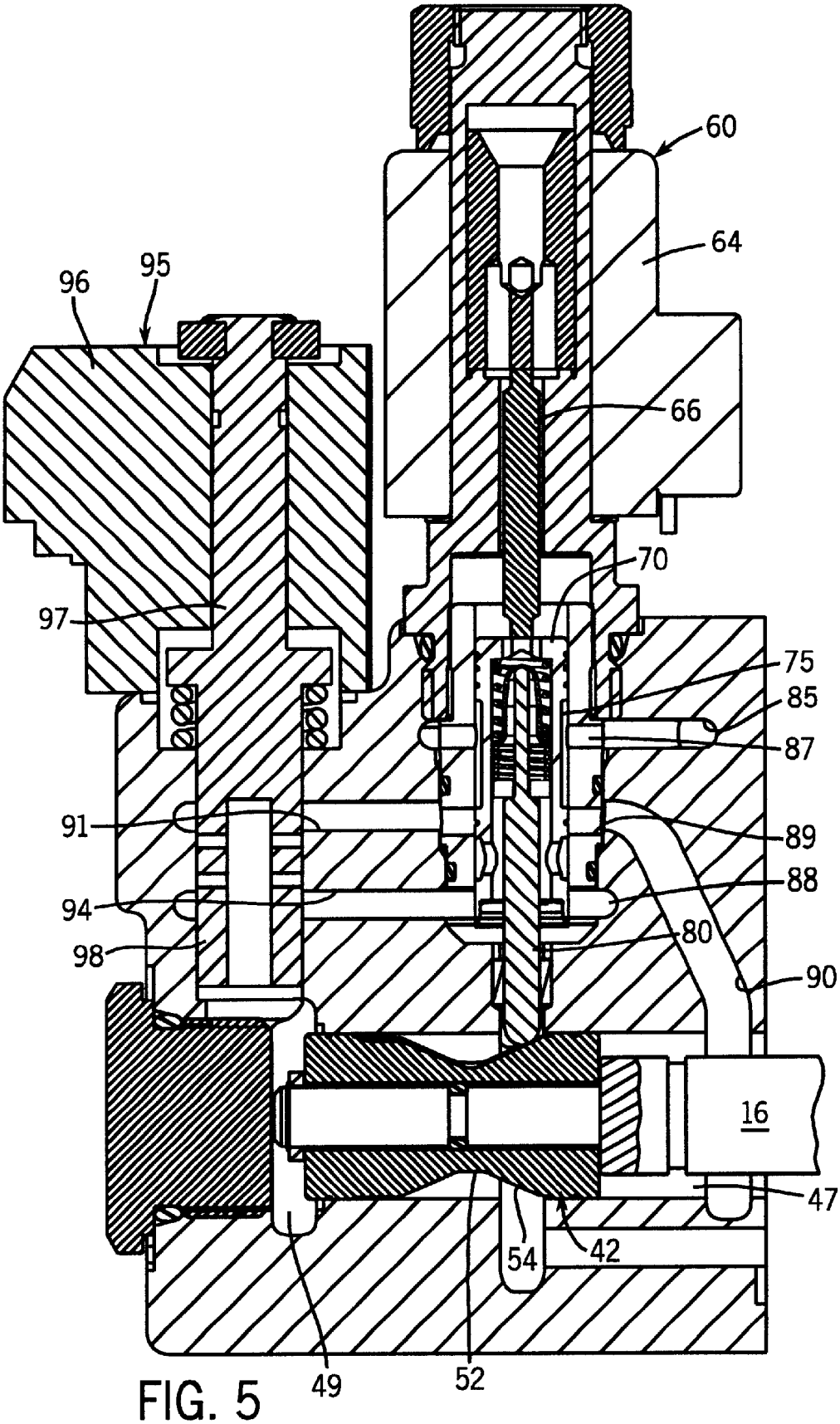
FIG. 5 is a cross section-through the linear actuator when the control valve is in the extend state.

With reference to FIG. 5, to extend the piston rod 39 from the cylinder 21, the second EH valve 95 is energized so that its valve member 98 connects the second transverse tank passage 94 to the second piston control chamber 49. The first EH valve 60 also is energized to move the valve element 70 to a position where the annular groove 75 extends between an inlet 87 and an outlet 89 of the valve and thereby proportionally metering fluid from the pilot pressure passage 85 to the branch passage 90 and into the first piston control chamber 47. Thus, the first piston control chamber 47 will contain fluid at a relatively high pressure as compared to the pressure in the second piston control chamber 49. This pressure differential forces the piston 42 to the left in the drawing, producing a corresponding movement of the flow control component, spool 16. This leftward motion of the control spool 16 connects the second work port passage 23 and second work port 20 to the tank passage 27. At the same timed the first work port 18 and its passage 22 are connected to the bridge passage 38 which receives fluid at the pump output pressure. As a consequence, the piston within cylinder 21 moves to the left in the drawings thereby extending the piston rod 39 from the cylinder, as is apparent from FIG. 1.

As the piston 42 of the force feedback actuator 40 moves to the left in the drawings, the force feedback pin 80 rides up the tapered section 54 on the piston which forces the pin 80 into the first EH valve 60. This exerts upward feedback force on the valve element 70, which counteracts the downward force from the first solenoid 64, thereby causing the spool to move in a direction which tends to close communication between the pilot pressure passage 85 and the branch passage 90. This upward movement of the pilot pin 80 compresses the first spring 74 (FIG. 2) exerting an upward pressure on the valve element 70. This exertion of an upward force on the valve element 70 due to the engagement of the pilot pin 80 with piston's tapered section 54 provides a spool position feedback force which acts on the first EH valve 60.

Thus, the magnitude of electric current applied to the first solenoid 64 of the first EH valve 60 produces a downward force applied via armature 66 to the valve element 70. That downward force corresponds to a desired position for the control spool 16. When the control spool 16 reaches the desired position, the upward force exerted by the pilot pin 80 on the valve element 70 matches the downward force produced by the first solenoid 64. Thus, the force feedback actuator 40 reaches equilibrium at the desired position of the control spool 16 where the valve element 70 is in a closed position and the pilot pressure $P_{ILOT}$ in no longer being applied to the first piston control chamber 74. Therefore, as other forces acting on the control spool 16, such as friction and change in the force of the dual action spring assembly 15 occur over time, the force feedback actuator 40 compensates for those changes. Specifically, the force feedback actuator 40 will consistently move the control spool 16 into the desired position where the force exerted by the pilot pin 80 moving on the tapered section 54 of the piston 42 counters the force produced by the electric current in the first solenoid 64 of the first EH valve 60. This force equilibrium occurs when the spool has moved into the desired position regardless of variation of friction or the force of the dual action spring 15.

Figure 6:
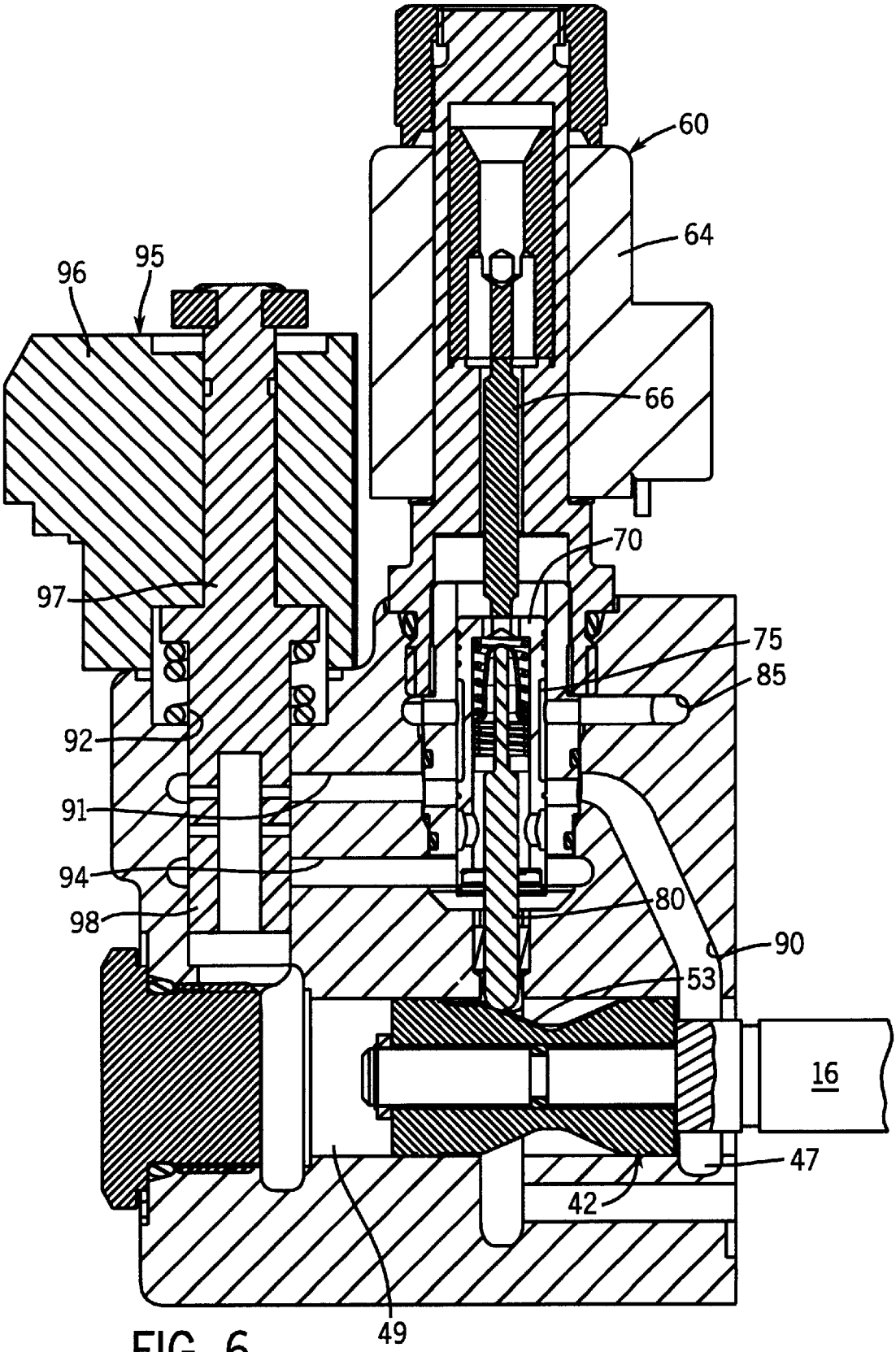
FIG. 6 is a cross section through the linear actuator when the control valve is in the retract state.

Referring FIG. 6, a similar action occurs when it is desired to retract the piston rod 39 into the cylinder 21. In this mode of operation, the second EH valve 95 is de-energized which places its valve member 98 in a position which provides a connection between the first transverse passage 91 and the second piston control chamber 49. Thus, as the first EH valve 60 is energized to proportionally meter fluid from the pilot pressure passage 85 into the branch passage 90 and first transverse passage 91, fluid at that pressure will be applied to both the first and second piston control chambers 47 and 49. As can be seen in the drawing, the surface of the piston 42 exposed to the first chamber 47 is less than the piston surface area exposed to the second piston control chamber 49. Preferably, the piston surface area in the second piston control chamber 49 is twice that of the area exposed to the first piston control chamber 47. In this operating, mode as a result, a greater amount of hydraulic force is exerted on the end of the piston which is remote from the control spool 16, causing movement of the piston 42 and the control spool to the right in the drawings. This motion places the control spool 16 into a position in which the first work port 18 and passage 22 are connected to the tank passage 26. In additions the control spool 16 now provides a path from the second work port 20 and its passage 23 to the bridge passage 38 which is at pump supply pressure. As a consequence, the piston of cylinder 21 moves rightward in the drawings, retracting the attached rod 39 into the cylinder.

That rightward movement of the piston 42 causes the pilot pin 80 to ride up tapered section 53 thereby pushing the pilot pin into the first EH valve 60. This movement of the pilot pin 80 exerts an upward force on the valve element 70 which counteracts the downward force from the armature 66 when the first solenoid 64 is energized. Thus, when the control spool 16 and piston 42 move into the desired position corresponding to the magnitude of electric current applied to the first solenoid 64 of the first EH valve 60, the upward force from the pilot pin 80 reaches an equilibrium with the downward force exerted by the solenoid armature 66. When this occurs, the valve element 70 is placed in a position which closes communication between the pilot pressure passage 85 and the branch passage 90 and first transverse passage 91. At that time, pressurized fluid no longer is being applied to either piston control chamber 47 or 49 and movement of the piston and control spool 16 terminates.

Thus, in the retract mode, the piston 62 engaging the pilot pin 80 provides a force feedback mechanism which indicates when the control spool 16 has reaches the desired position corresponding to the magnitude of electric current applied to the first solenoid 64. The valve element 70 will reopen communication between the pilot pressure passage 85 and the two piston control chambers 47 and 49 only if the control spool moves to the left due to external forces acting upon it. Thus, in the retract mode, the force feedback actuator 40 accurately positions the control spool 16 even though other forces such as friction and the force of the dual action spring 15 acting on the control spool 16 may change over time.

Figure 7:
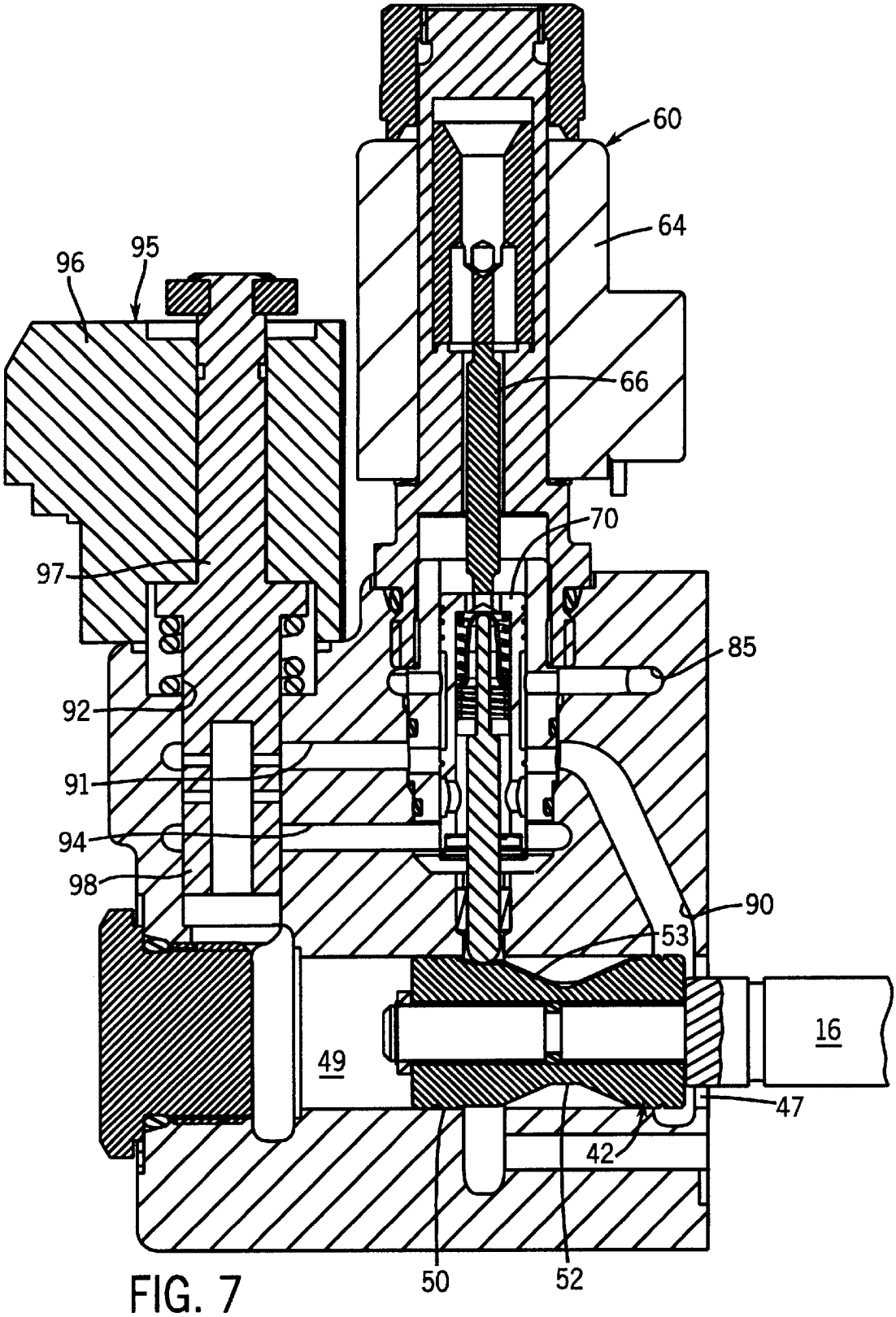
FIG. 7 is a cross section through the linear actuator when the control valve is in the float state.

With reference to FIG. 7, the control spool 16 also may be placed into a float position in which both of the work ports 18 and 20 are connected to the tank passages 26 and 27. When the operator of the machine on which the control valve 10 is incorporated activates an input device designating the float position, a relatively high electric current level is applied to the first EH valve 60. The second EH valve 95 is placed into a de-energized state in which its valve member 98 provides a path between the first transverse passage 91 and the second piston control chamber 49. The electric current applied to the first solenoid 64 of the first EH valve 60 forces the valve element 70 downward to provide a relatively large path between the pilot pressure passage 85 and both the branch passage 90 and first transverse passage 91. This applies pressurized fluid to the two piston control chambers 47 and 49 which, due to the differential of the piston surface areas in each chamber, drives the piston and the connected control spool 16 to the right in the drawings. Because the first solenoid 64 applies a relatively large downward force on the valve element 70, the upward movement of the pin 80 on ramp surface 58 does not close the communication between the pilot pressure passage 85 and the other passages 90 and 91. As a consequence, the actuator piston 42 is driven the full available distance to the right, pushing the control spool 16 into a position in which both of the first and second work ports 18 and 20 have their respective passages 22 and 23 connected to the tank passages 26 and 27, respectively. This enables the piston of cylinder 21 to float, moving in response to external forces exerted upon the piston rod 39.

The foregoing description was primarily directed to a preferred embodiment of the invention. Although some attention was given to various alternatives within the scope of the invention, it is anticipated that one skilled in the art will likely realize additional alternatives that are now apparent from disclosure of embodiments of the invention. Although the present force feedback actuator has been described in the context of operating a spool type control valve, the actuator can be use to operate other devices, such as the swash plate of a variable displacement pump for example. Accordingly, the scope of the invention should be determined from the following claims and not limited by the above disclosure.

What is claimed is:

1. A hydraulic apparatus comprising:

a machine member;

a body with a bore therein;

a piston mechanically coupled to the machine member and located within the bore thereby defining a first control chamber and a second control chamber on opposite sides of the piston, the piston has a first end and a second end with a contoured surface there between wherein the contoured surface has oppositely tapering first and second tapered sections;

a valve assembly having a valve element which moves to meter pressurized fluid selectively to the first and second control chambers to move the piston in opposite directions which moves the machine member, the valve assembly including an actuator which produces a first force that is applied to move the valve element; and a pilot pin which engages the piston and the valve assembly wherein movement of the pilot pin on the first and second tapered sections exerts a second force to the valve element.

2. The hydraulic apparatus as recited in claim 1 wherein the second force at least partially counteracts the first force.

3. The hydraulic apparatus as recited in claim 1 wherein the valve assembly comprises:

a first electrohydraulic valve that includes the actuator and the valve element and having first state in which the pressurized fluid is proportionally metered to an outlet connected to the first control chamber, a second state in which the outlet is coupled to the tank passage, and a third state in which the outlet is isolated from both the tank passage and the pressurized fluid; and a second electrohydraulic valve which has a fourth state in which the second control chamber is coupled to the tank passage, and a fifth state in which the second control chamber is coupled to the outlet of the first electrohydraulic valve.

4. The hydraulic apparatus as recited in claim 1 further comprising a cap, a first spring biasing the cap away from the valve element, and a second spring biasing the cap away from the pilot pin.

5. The hydraulic apparatus as recited in claim 1 wherein the piston has a first surface area in the first control chamber that is smaller than a second surface area of the piston in the second control chamber.

6. The proportional hydraulic control valve as recited in claim 1 wherein the piston has a circular cross sectional shape, and the first tapered section and the second tapered section both have frustoconical shapes each with a larger diameter end adjacent a different one of the first end and a second end.

7. The hydraulic apparatus as recited in claim 1 wherein the first tapered section tapers inwardly going away from the first end, and the second tapered section tapers inwardly going away from the second end.

8. The hydraulic apparatus as recited in claim 1 wherein the piston has a longitudinal groove within which an end of the pilot pin is received.

9. The hydraulic apparatus as recited in claim 1 wherein:

the body further comprises a work port, a supply passage, and a tank passage all of which communicate with the bore; and the machine member comprises a flow control component coupled to the piston and movably accommodated in the bore to define a first fluid path between the work port and the supply passage and a second fluid path between the work port and the tank passage.

10. A hydraulic apparatus comprising:

a body with a spool bore therein, and having a first work port, a second work port, a supply passage, and a tank passage all of which communicate with the spool bore;

a control spool accommodated in the spool bore for reciprocal movement therein, the control spool having a first location at which the first work port is coupled to the supply passage and the second work port is coupled to the tank passage, a second location at which the first work port is coupled to the tank passage and the second work port is coupled to the supply passage, and a third location at which the first work port and the second work port are isolated from the supply passage and the tank passage;

a piston coupled to the control spool and defining a first control chamber and a second control chamber on opposite sides of the piston, the piston having a first end and a second end with a depression there between, the depression having a first tapered section and a second tapered section;

a first electrohydraulic valve having a first actuator coupled to a valve element which has first state in which the pressurized fluid is proportionally metered to an outlet connected to the first control chamber, a second state in which the first control chamber is coupled to a tank passage, and a third state in which the first control chamber is isolated from both the tank passage and the pressurized fluid;

a second electrohydraulic valve which has a second actuator coupled to a valve member which has a fourth state in which the second control chamber is coupled to the tank passage, and a fifth state in which the second control chamber is coupled to the outlet of the first electrohydraulic valve; and a pilot pin which engages the piston and the valve element wherein movement of the pilot pin on the first and second tapered sections exerts a force to the valve element.

11. The hydraulic apparatus as recited in claim 10 wherein the force exerted by the pilot pin varies in response to movement of the spool.

12. The hydraulic apparatus as recited in claim 10 wherein the force exerted by the pilot pin on the valve element has a direction that is opposite to a direction of a force applied by the first actuator to the valve element.

13. The hydraulic apparatus as recited in claim 10 wherein the valve element has an aperture within which an end of the pilot pin is received.

14. The hydraulic apparatus as recited in claim 13 further comprising a cap, a first spring biasing the cap away from the valve element, and a second spring biasing the cap away from the pilot pin.

15. The hydraulic apparatus as recited in claim 10 wherein the body further comprises:

a first bore within which the valve element of the first electrohydraulic valve is received;

a second bore in communication with the second control chamber and within which the valve member of the second electrohydraulic valve is received;

a pilot pressure passage receiving the pressurized fluid and communicating with the first bore;

a pilot tank passage communicating with the first bore, the second bore and the tank passage;

a branch passage connecting the outlet of the first electrohydraulic valve to the first control chamber; and a transverse passage connecting the outlet of the first electrohydraulic valve to the second bore.

16. The hydraulic apparatus as recited in claim 15 wherein:

the first electrohydraulic in the first state connects the pilot pressure passage to both the branch passage and the transverse passage, and in the second state connects the branch passage to the pilot tank passage; and the second electrohydraulic valve in the fourth state couples the second control chamber to the pilot tank passage, and in the fifth state couples the second control chamber to the transverse passage.

17. A hydraulic apparatus comprising:

a body with a valve bore therein, and having a first work port, a supply passage, and a tank passage all of which communicate with the valve bore;

a flow control component movably accommodated in the valve bore to define a first fluid path between the work port and the supply passage and a second fluid path between the work port and the tank passage;

a piston coupled to the flow control component and defining a first control chamber and a second control chamber on opposite sides of the piston, the piston having a first end and a second end with a depression there between, the depression having a first tapered section and a second tapered section;

a first electrohydraulic valve having a first actuator coupled to a valve element which has first state in which the pressurized fluid is proportionally metered to an outlet connected to the first control chamber, a second state in which the first control chamber is coupled to a tank passage, and a third state in which the first control chamber is isolated from both the tank passage and the pressurized fluid; and a second electrohydraulic valve which has a second actuator coupled to a valve member which has a fourth state in which the second control chamber is coupled to the tank passage, and a fifth state in which the second control chamber is coupled to the outlet of the first electrohydraulic valve.

18. The hydraulic apparatus as recited in claim 17 further comprising a pilot pin which engages the piston and the valve assembly, wherein movement of the pilot pin on the first and second tapered sections applies force to the valve element.

19. The hydraulic apparatus as recited in claim 18 wherein the force applied by the pilot pin corresponds to a position of the spool.

20. The hydraulic apparatus as recited in claim 18 wherein the force applied by the pilot pin has a direction that is opposite to direction of a force applied by the first actuator to the valve element.

21. The hydraulic apparatus as recited in claim 17 wherein the body further comprises:

a first bore within which the valve element of the first electrohydraulic valve is received;

a second bore in communication with the second control chamber and within which the valve member of the second electrohydraulic valve is received;

a pilot pressure passage receiving the pressurized fluid and communicating with the first bore;

a pilot tank passage communicating with the first bore, the second bore and the tank passage;

a branch passage connecting the outlet of the first electrohydraulic valve to the first control chamber; and a transverse passage connecting the outlet of the first electrohydraulic valve to the second bore.

22. The hydraulic apparatus as recited in claim 21 wherein:

the first electrohydraulic in the first state connects the pilot pressure passage to the branch passage and the transverse passage, and in the second state connects the branch passage to the pilot tank passage; and the second electrohydraulic valve in the fourth state couples the second control chamber to the pilot tank passage, and in the fifth state couples the second control chamber to the transverse passage.

* * * * *